US008360116B1

(12) United States Patent
Maxwell

(10) Patent No.: US 8,360,116 B1
(45) Date of Patent: Jan. 29, 2013

(54) STANDALONE ICE DISPENSER

(76) Inventor: Tim Maxwell, Camilla, GA (US)

( * ) Notice: Subject to any disclaimer, the term of this patent is extended or adjusted under 35 U.S.C. 154(b) by 661 days.

(21) Appl. No.: 12/592,733

(22) Filed: Dec. 1, 2009

Related U.S. Application Data

(63) Continuation-in-part of application No. 11/804,315, filed on May 18, 2007, now Pat. No. 7,624,773.

(51) Int. Cl.
*B65B 1/10* (2006.01)
*B65B 1/32* (2006.01)

(52) U.S. Cl. ..... 141/82; 141/98; 141/114; 141/166; 141/317; 222/146.6; 222/167

(58) Field of Classification Search ..... 141/82, 141/98, 114, 165–166, 313–317; 222/56, 222/146.6, 167
See application file for complete search history.

(56) References Cited

U.S. PATENT DOCUMENTS 4,689,937 A * 9/1987 Finan et al. ..... 53/502
4,878,523 A * 11/1989 Balsamico et al. ..... 141/114
5,109,651 A * 5/1992 Stuart ..... 53/502
5,277,016 A * 1/1994 Williams et al. ..... 53/459
5,473,865 A * 12/1995 Tanaka et al. ..... 53/502
5,581,982 A * 12/1996 Schroeder et al. ..... 141/317
5,630,310 A * 5/1997 Chadwell ..... 53/502
6,112,539 A * 9/2000 Colberg ..... 62/331
6,904,946 B2 * 6/2005 James ..... 141/114
6,932,124 B2 * 8/2005 Dalton et al. ..... 141/82
7,062,892 B2 * 6/2006 Metzger ..... 53/440
7,104,291 B2 * 9/2006 Dalton et al. ..... 141/82
7,207,156 B2 * 4/2007 Metzger ..... 53/440
7,421,834 B1 * 9/2008 Doolan ..... 222/452
7,426,812 B2 * 9/2008 Metzger ..... 53/459
7,426,945 B2 * 9/2008 Dalton et al. ..... 141/82
7,497,062 B2 * 3/2009 Metzger ..... 53/58
7,624,773 B2 * 12/2009 Maxwell ..... 141/114
7,806,152 B2 * 10/2010 Dalton et al. ..... 141/83
7,810,301 B2 * 10/2010 Metzger ..... 53/459
7,849,660 B2 * 12/2010 Metzger ..... 53/58
8,132,392 B2 * 3/2012 Metzger ..... 53/64
8,245,488 B2 * 8/2012 Dunn ..... 141/82
2004/0084106 A1 * 5/2004 James ..... 141/313
2006/0174969 A1 * 8/2006 Dalton et al. ..... 141/114
2008/0110129 A1 * 5/2008 LeBlanc et al. ..... 53/127

* cited by examiner

*Primary Examiner* — Gregory Huson
*Assistant Examiner* — Nicolas A Arnett

(57) ABSTRACT

A standalone ice dispenser delivers ice in bagged form. The device uses a cone-shaped drum with an upwardly oriented mount that receives and stores the ice is gravitationally delivered to the drum from an ice maker. A motor rotates the drum such that a fin therein causes ice to advance toward and eventually out of the mouth of the drum. A bagging system uses a hopper that receives ice from the drum such that a blower to blow open a bag and thereafter a trap door drops allowing ice to drop from the hopper into the bag. Thereafter, the bagged ice drops to a floor panel which raises the bagged ice into a chute. Weight sensors attached to the drum determine whether the drum is empty or full and control operation of the ice maker.

14 Claims, 8 Drawing Sheets

STANDALONE ICE DISPENSER

The present application is a Continuation-In-Part of U.S. patent application Ser. No. 11/804,315, filed on May 18, 2007, now U.S. Pat. No. 7,624,773, which patent is incorporated herein in its entirety.

BACKGROUND OF THE INVENTION

1. Field of the Invention

The present invention relates to a standalone ice dispenser that uses a simplified ice advancing mechanism.

2. Background of the Prior Art

Standalone ice dispensers have gained in popularity in recent times. These devices, which are typically placed in a parking lot or similar location, automatically sell ice to consumers without the need for an attendant to be present. The standalone ice dispenser, which is about the size of a large shed, is placed at the desired location and is hooked up to a local water supply and to a source of electricity. Once operational, the ice dispenser manufactures ice, which ice is sold to consumers by having the consumer approach the device and place a payment into an appropriate receiver, in similar fashion to the operation of a soda machine. Once the payment is received by the machine, a quantity of ice is measured out and is dispensed to the consumer, typically in a bag, however, some machines also dispense in bulk form directly to the consumer's receptacle.

These standalone ice dispensers are great for consumer and owner alike. Once the device is properly installed, there is no need for human involvement in the sales process so that the consumer can buy ice day or night and the owner has a revenue stream with relatively little operating expenses.

In order for a standalone ice dispenser to be efficient, the machine must make a substantial amount of ice, which ice is stored in an appropriate storage receptacle within the machine's housing. Advance manufacture of a large amount of ice assures that sufficient quantizes of ice are available for sale during peak purchase periods. Once ice is purchased, the ice is brought to the measuring and dispensing section of the device by an advancing system. The problem with current standalone ice dispensers is that the advancing system tends to be relatively complex in design and construction. This complexity increases the overall manufacturing cost of the device. Additionally, due to this complexity of the advancing system, the device is more prone to failure. Increased failure rates result in increased operating costs due to the need to have frequent service visits to each device to maintain proper operation of the device. Additionally, should the device malfunction, the machine may loose a substantial amount of revenue stream until the problem is resolved at the next service visit which may be relatively distant in the future.

What is needed is a standalone ice dispenser that has a relatively simple ice storage and advancing system so that the overall dispenser is relatively less complex in design and thus less expensive to manufacture. By having a simple storage and advancing system, service visits can be less frequent so as to reduce the operating expenses associated with the device and in order to reduce potential revenue robbing down time of the dispenser.

SUMMARY OF THE INVENTION

My previous application addressed and achieved such needs in the art. Through additional research and development, further positive changes have been made to my previous standalone ice dispenser. Accordingly, the standalone ice dispenser of the present invention addresses the aforementioned needs in the art by providing a standalone ice dispenser that sells ice at anytime without operator involvement, which dispenser has a relatively simple ice storage mechanism as well as a relatively simple ice advancing system between the storage mechanism and the dispensing mechanism. Simplicity in design of the storage and advancing systems allows for a less complex dispenser thereby allowing for a relatively less expensive machine. By simplifying the storage and advancing systems, the owner of the device is able to schedule service visits less frequently, thereby decreasing the overall operating costs and increasing the up time of the machine.

The standalone ice dispenser of the present invention is comprised of a housing that has an interior bounded by at least one wall and a chute extending from the interior and through the wall, the chute protruding through the wall to the exterior of the housing. A drum has an internal cavity and an upwardly oriented mouth and is rotatably disposed within the interior of the housing. An advancing fin is disposed on an inner surface of the internal cavity of the drum. A motor, which may, but not necessarily be electric, is operationally connected to the drum. An ice maker is attached to the housing such that the ice maker receives water and turns the water into ice. Once the ice is made, it is gravitationally discharged from the ice maker into the mouth of the drum via a delivery chute. At least one weight sensor may be connected to the drum for determining whether the drum has sufficient ice therein so that the ice maker is inactivated or needs to be filled so that the ice maker is activated. When the device is activated, the drum rotates in forward direction such that the advancing fin causes the ice disposed within the internal cavity of the drum to advance out of the mouth and fall into a hopper via a guide chute. When a sufficient quantity of ice has been received within the hopper, as determined by a sensor, the drum discontinues rotating. A bagging and delivery unit is disposed below the mouth of the drum such that the bagging unit causes the ice falling out of the mouth to be received within a bag with the bag and ice being delivered into the chute. The bagging unit comprises a frame that holds the hopper which hopper has a trap door at its bottom that pivots between a raised position and a lowered position. The hopper receives ice that falls out of the mouth of the drum via a guidance chute. A downwardly sloping bag rack is attached to the frame and receives a plurality of bags and positions the bags just below the trap door. A blower is attached to the frame and is positioned just above the end most bag so that the blower blow opens the end bag. A floor panel is pivotally attached to the frame and is capable of pivoting between a raised position and a lowered position. When the device is activated, the drum rotates such that the advancing fin causes the ice disposed within the internal cavity of the drum to advance out of the mouth and fall into the hopper and such that when a sufficient quantity of ice is present within the hopper, the drum discontinues rotating and thereafter the blower blow opens the bag and thereafter the trap door drops to the lowered position causing the ice within the hopper to drop into the blown open bag and thereafter the floor panel is pivoted to the raised position thereby delivering the bag with ice into the customer accessible chute. The drum is rotated via a motor that is operationally connected to the drum. A sensor is positioned proximate the open mouth of the drum in order to sense an ice back up in the delivery chute. If such a back up is sensed, the ice maker is deactivated and the drum is rotated in a normally reverse direction so as to cause the advancing fin to draw the ice into the bottom of the drum. The trap door is controlled by a first mechanical actuator while the floor panel is controlled by a second mechanical actuator. A payment system receives a payment prior to commencing the dispensing cycle for the ice. A sensor (possibly a see-through sensor) determines when sufficient ice is present within the hopper.

BRIEF DESCRIPTION OF THE DRAWINGS

Similar reference numerals refer to similar parts throughout the several views of the drawings.

DESCRIPTION OF THE PREFERRED EMBODIMENT

Figure 1:
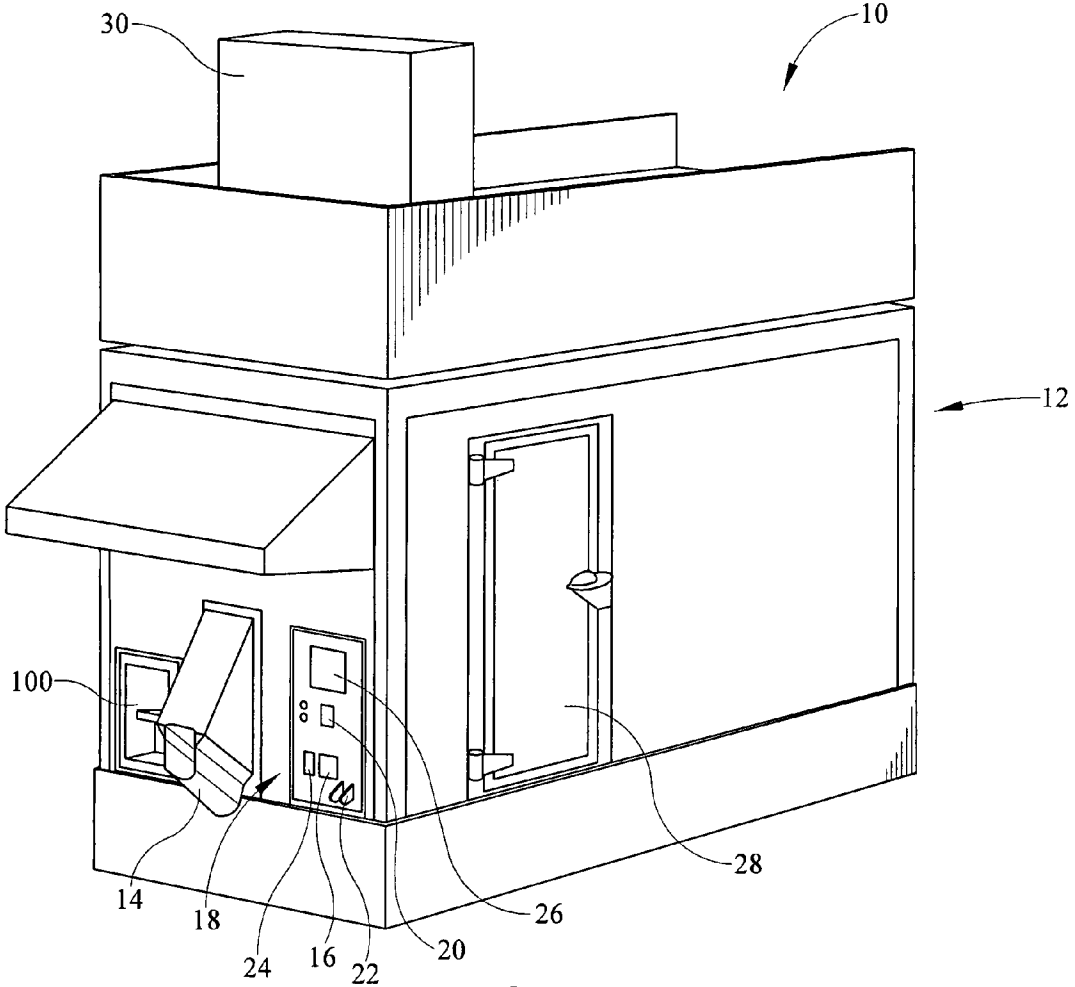
FIG. 1 is a perspective view of the standalone ice dispenser of the present invention.
Figure 2:
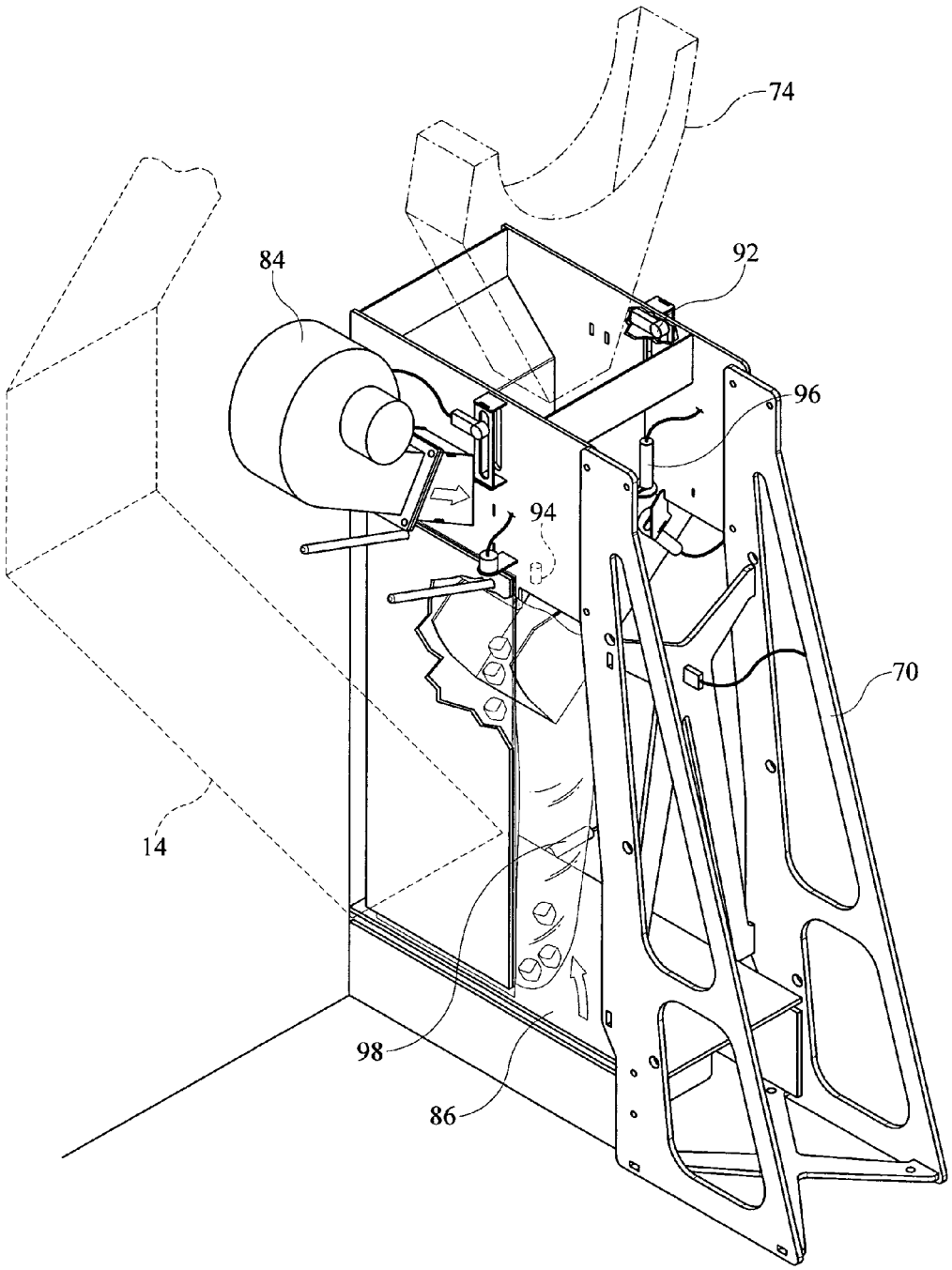
FIG. 2 is a perspective view of the bag filling station used by the standalone ice dispenser.
Figure 3:
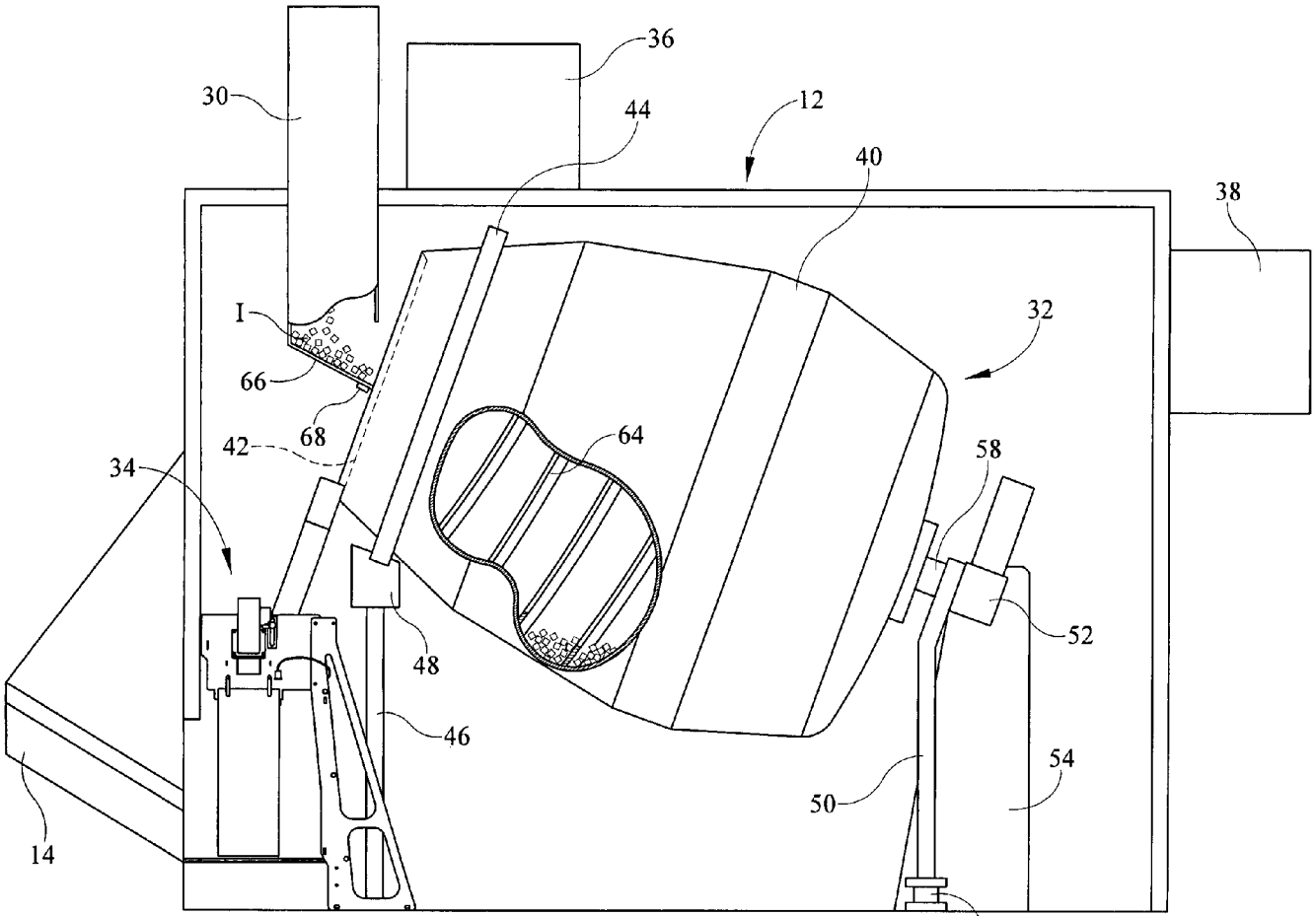
FIG. 3 is a right side view of the interior of the standalone ice dispenser.
Figure 4:
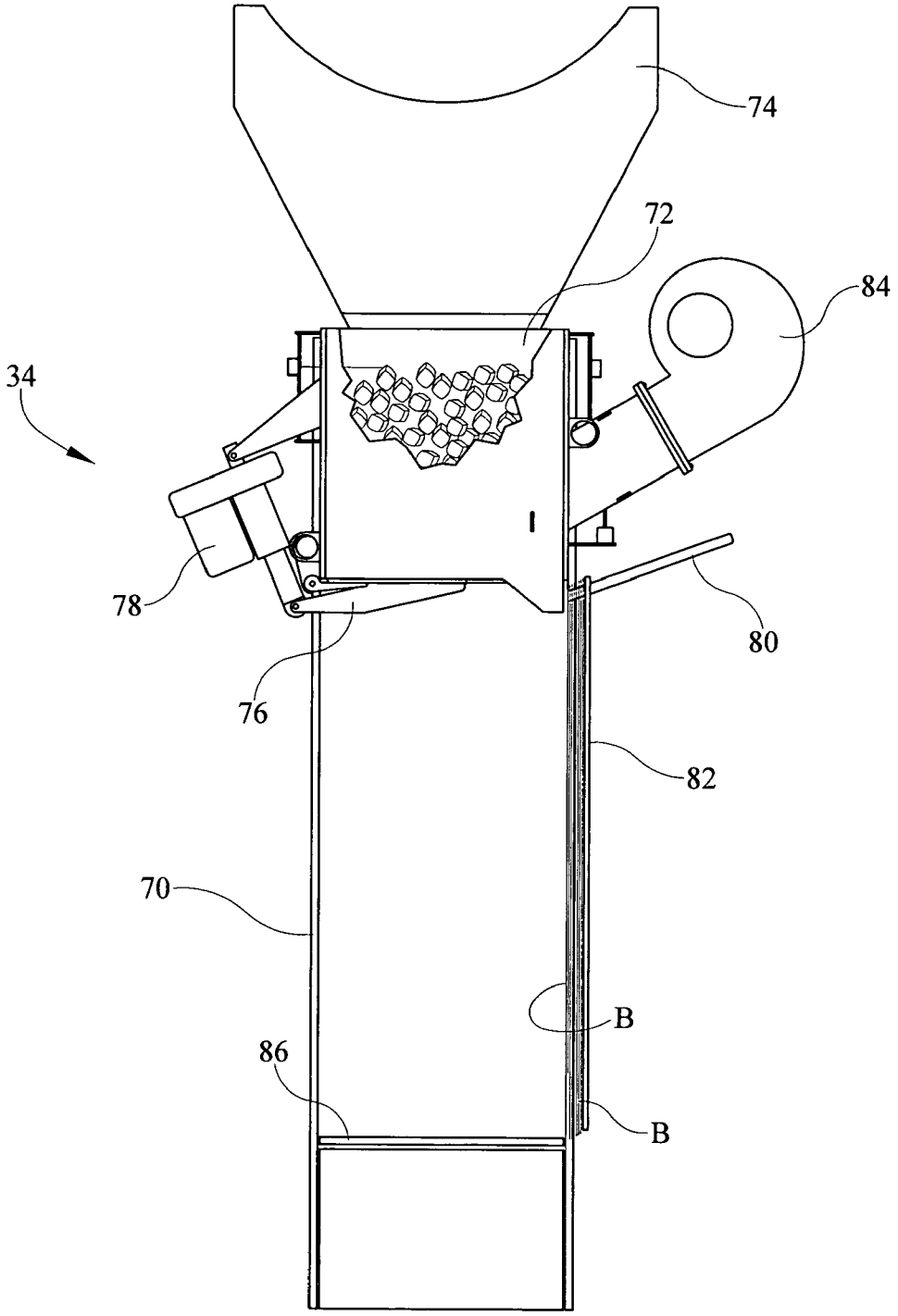
FIG. 4 is a front view of the bag filling station with the hopper's trap door flap in the up position allowing the hopper to be filled with ice.
Figure 5:
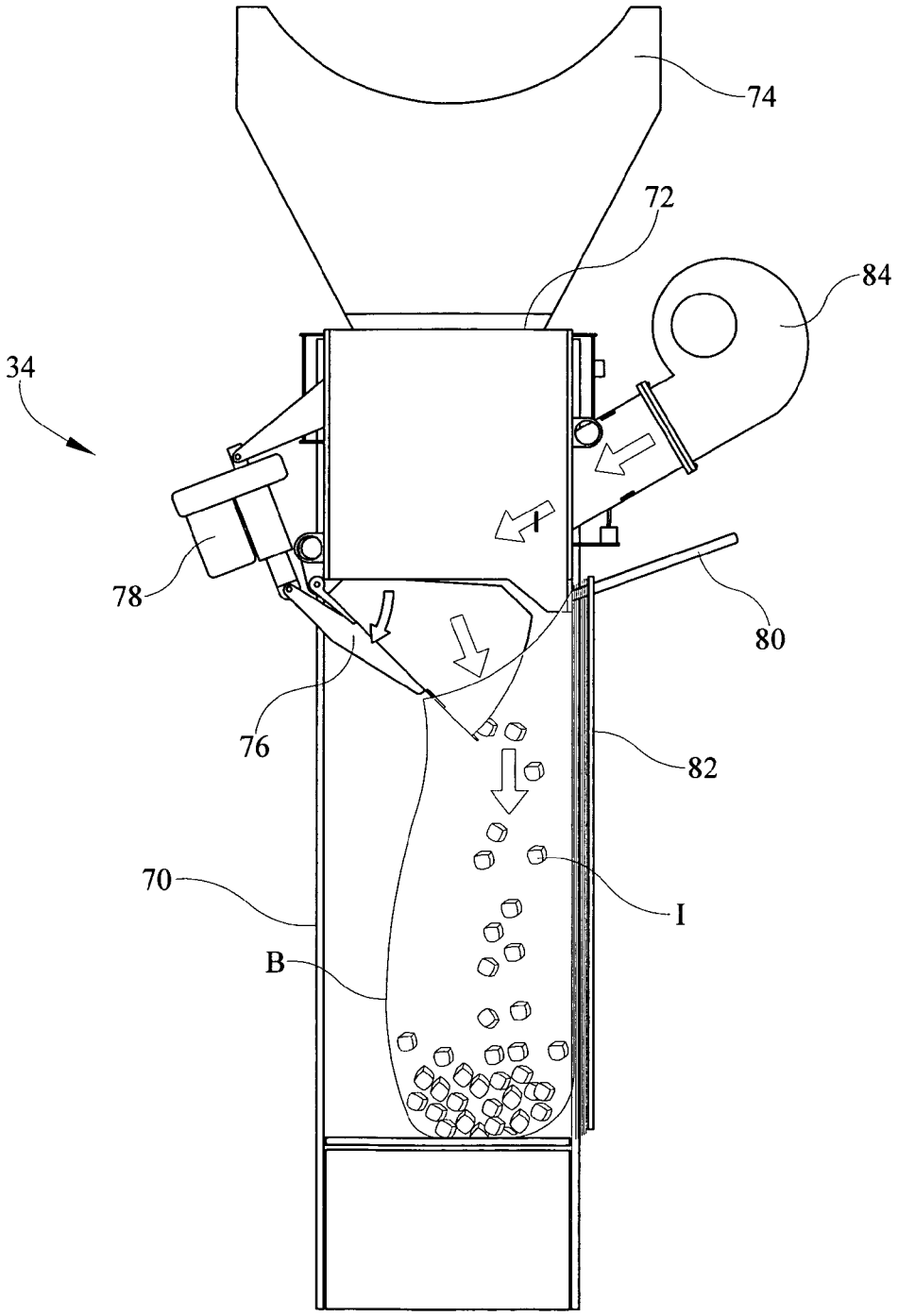
FIG. 5 is a front view of the bag filling station with the hopper's trap door flap in the down position dumping ice into the bag.
Figure 6:
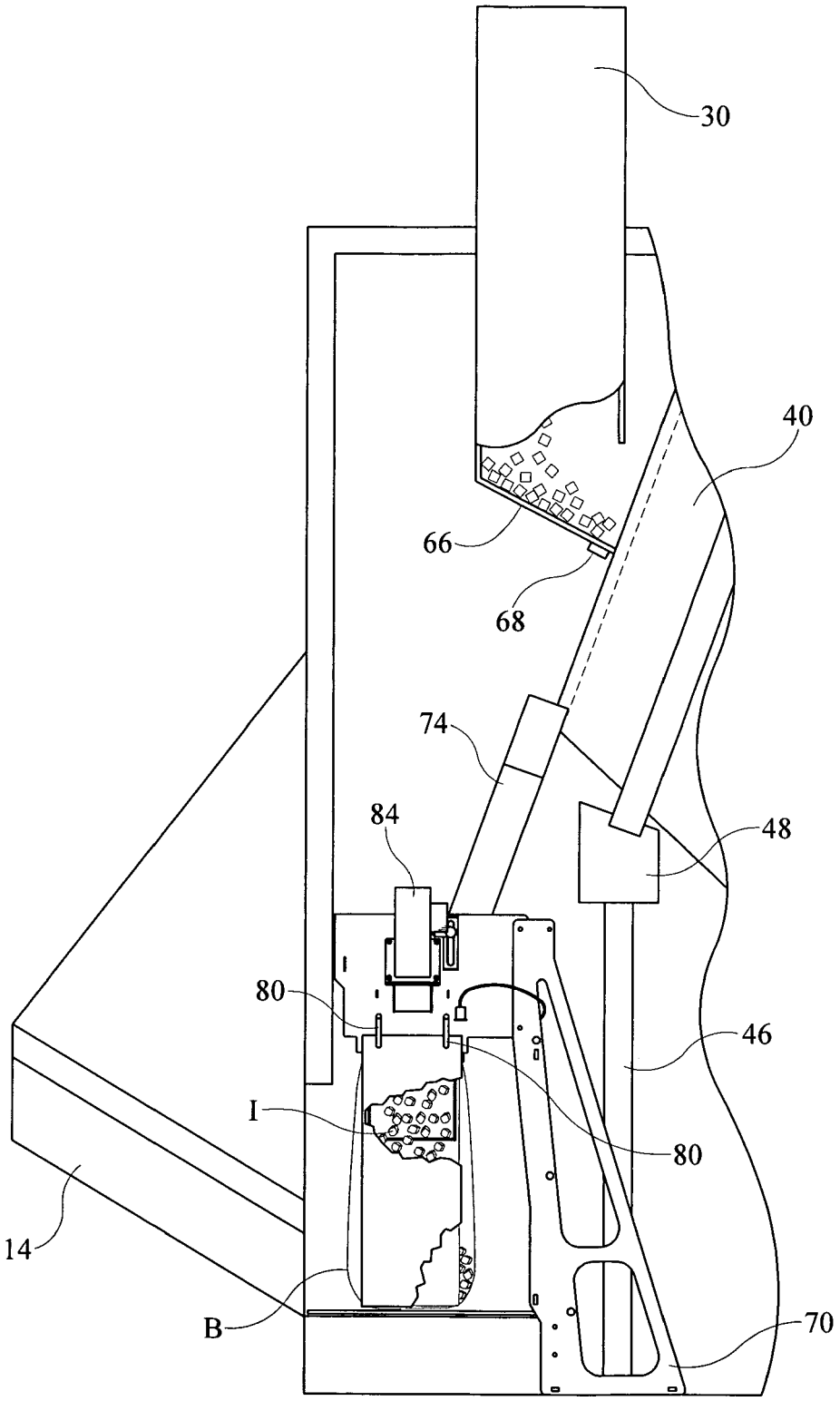
FIG. 6 is a right side view of the bag filling station with the bag being filled.
Figure 7:
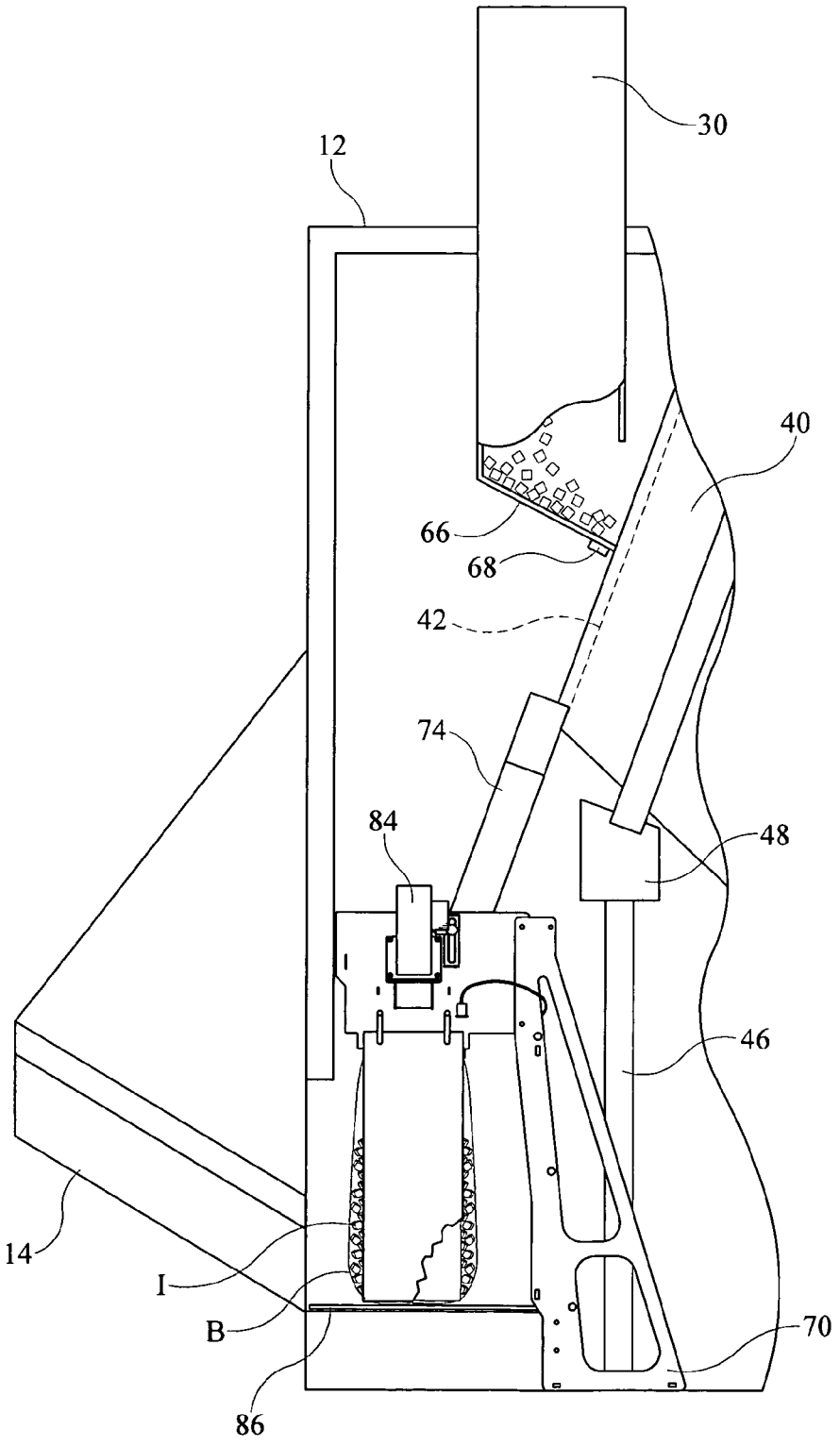
FIG. 7 is a right side view of the bag filling station with the bag full.
Figure 8:
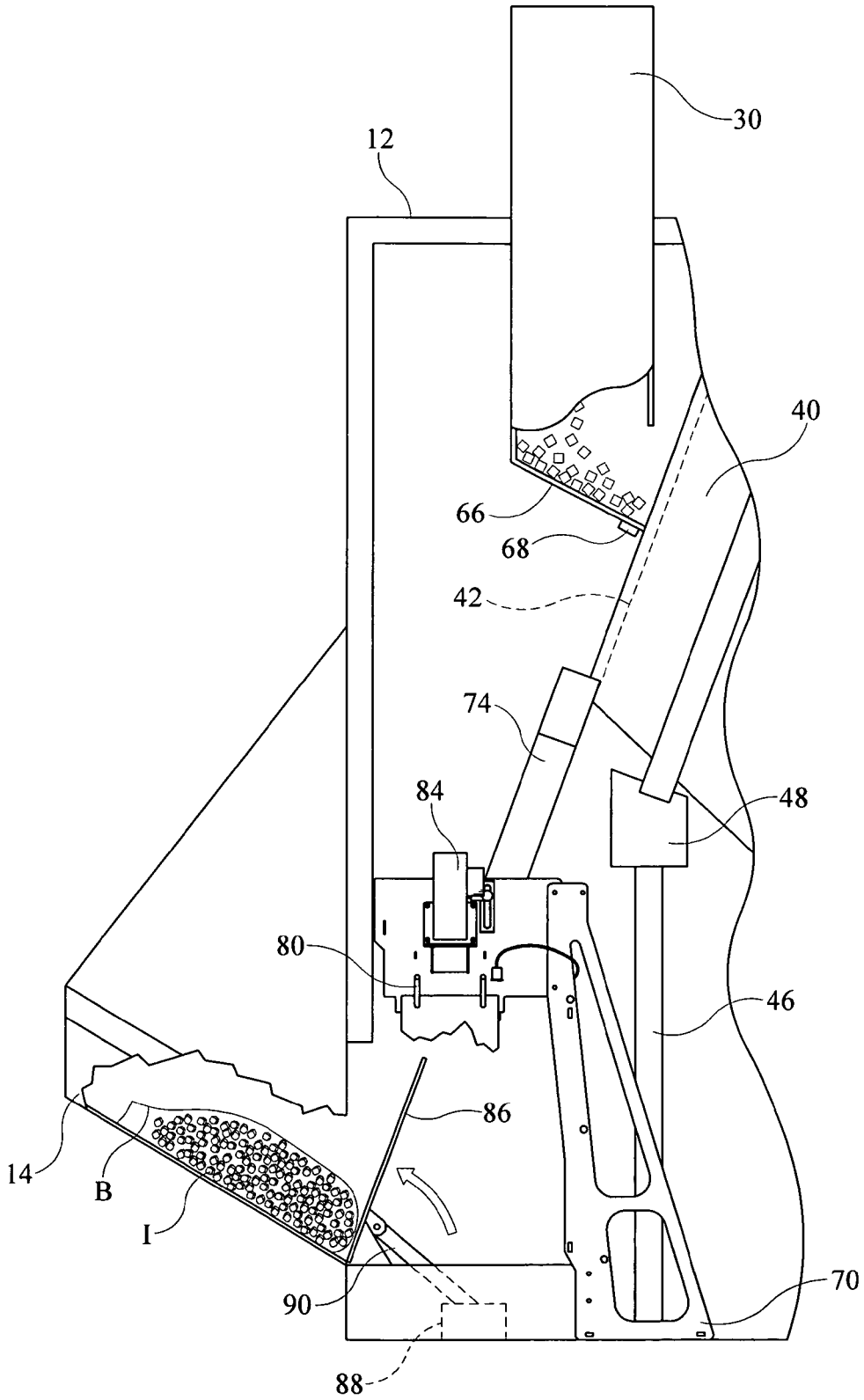
FIG. 8 is a right side view of the bag filling station with the bag full and being delivered into the chute.

Referring now to the drawings, it is seen that the standalone ice dispenser of the present invention, generally denoted by reference numeral 10, is comprised of a housing 12 that has a dispensing chute 14, the ice I being delivered to the consumer through the chute 14. A storage window 16 holds twist ties that are used to tie the bag B that is dispensed through the chute 14. Also located on the exterior of the housing 12 is a payment center 18 that has a money acceptor of any appropriate design including a bill acceptor and a coin acceptor 20, a change slot 22, a credit card acceptor 24 that communicates with an appropriate financial clearing house via a cellular telephone (also not illustrated) for accepting such credit and debit card payments from a consumer, and a selection panel 26 for selecting desired quantities and for allowing other interactions with the device 10. A service door 28 is also located on the housing 12 for providing service access into the interior of the housing 12

Located on the roof the housing 12 is an ice maker 30 of any appropriate design, an ice storage system 32 which includes an ice advancing system, and an ice measuring and dispensing system 34. A first cooling unit 36 sits atop or on the side or back of the housing 12 and provides cooling for the ice maker 30 while a second cooling unit 38 also sits atop or on the side or back the housing 12 and keeps the inside of the housing 12 at an appropriate temperature in order to keep the produced ice I in top form during storage.

As seen, the ice storage system 32 comprises a cone-shaped drum 40 that has an upwardly oriented open mouth 42 and a mount ring 44. The drum 40 is rotatably mounted on a front post 46 with the mount ring 44 being received within a drive guide 48 located atop the front post 46. The drum 40 also sits atop a rear post 50. An electric motor 52 is located atop a mount 54 proximate the rear post 50 and is operationally connected to the bottom of the drum 40 in any appropriate fashion such as having the motor 52 connected to the drum 40 via a gear box 58 attached to the drum 40. Located at the base of each post 46 and 50 are weight sensors 62. Located within the drum 40 are one or more advancing fins 64. The ice maker 30 has a delivery chute 66 that feeds into the open mount 42 of the drum 40. A sensor 68 is located at the end of the delivery chute 66 proximate the open mouth 42 of the drum 40. This sensor 68 senses for an ice back up in the delivery chute 66. If such a back up is sensed by the sensor 68, the ice maker 30 is deactivated and the drum 40 is counterrotated (in a direction that is reverse relative to the normal direction of rotation of the drum 40) so as to cause the advancing fin 64 toward draw the ice into the bottom of the drum 40 and thereby clear the ice back up at the delivery chute 66.

As seen, the ice measuring and dispensing system 34 comprises a frame 70 that holds a hopper 72 that has a chute 74 extending to the open mouth 42 of the drum 40. A trap door 76 is located at the bottom of the hopper 72 and is controlled by a first electrically powered mechanical actuator 78 that opens and closes the trap door 76. A pair of downwardly sloping bag racks 80 is attached to the frame 70 and holds a plurality of bags B thereon and has either spring-loaded or a weighted panel 82 pushing the bags B forwardly toward the underside of the trap door 76 so that the end bag B, the bag B furthest from the panel 82 is positioned underneath the trap door 76. A blower 84 is located just above this bag B. A floor panel 86 is located at the proximal end of the chute 14 and is pivotally attached to the frame 70 such that the floor panel 86 is capable of articulating between a raised position and a lowered position, with the floor panel 86 being raised and lowered by a second electrically powered mechanical actuator 88 that is connected to the underside of the floor panel 86 via a linkage 90.

In operation, the standalone ice dispenser 10 is placed at a desired spot and is connected to a source of electrical power and to a source of potable water in the usual way. Once the device 10 is operational, the ice maker 30 produces ice I and as each batch of ice I is made, the ice I drops out of the bottom of the ice maker 30 and is deposited in the drum 40 via the delivery chute 66. Once the drum 40 has a sufficient amount of ice I stored therein, as determined by the weight sensors 62—the precise amount being dependent on the size of the overall device 10 including the drum 40—the ice maker 30 discontinues producing ice I. A customer goes to the payment center 18 and deposits the appropriate amount of money (or inserts a credit card or debit card if the unit 10 is so configured) and selects his or her purchase. Once the purchase is selected and payment is accepted, the ice I delivery cycle begins. The motor 52 activates causing the drum 40 to rotate. As the drum 40 rotates, the advancing fin 64 within the internal cavity of the drum 40 causes ice Ito advance upwardly toward and eventually out of the open mount 42 of the drum 40. As the ice I advances out of the drum 40, the ice I falls into the hopper 72 under guidance of the hopper chute 74. A sensor 92 at the top of the hopper 72 is used to detect the presence of ice I, so that once the sensor 92 detects ice, due to the hopper 72 being sufficiently full, the motor 52 discontinues operating so that the drum 40 discontinues rotating so that no further ice I advances out of the drum 40. Once the drum 40 discontinues turning, the blower 84 activates in order to blow open the end bag B. Once the bag B is inflated, as determined by a sensor 94, the first actuator 78 causes the trap door 76 to drop allowing the ice I being held by the trap door 76 to gravitationally fall into the just blown open bag B. The trap door 76 remains in this dropped or open position for a fixed amount of time and thereafter, the first actuator 78 returns the trap door 76 to its raised or closed position. A proximity sensor 96 senses the trap door 76 returning to the raised position. This in turn activates the second actuator 88 which raises the floor panel 86 to its raised position which pushes the bag B of ice out into the chute 14 for delivery to the customer.

After a predetermined amount of time, the second actuator 88 returns the floor panel 86 to its lowered position. A proximity switch 98 senses the return of the floor panel to the lowered position causing the overall device 10 to be reset and ready for another ice delivery cycle.

Once the weight sensors 62 at the base of the posts 46 and 50 sense that the weight of the drum 40 has fallen below a certain level, the ice maker 30 is again activated in order to restock the drum 40 with ice I. The ice maker 30 remains operation until the weight sensors 62 determine that the weight of the drum 40 is above a predetermined value.

Operation of the various systems is controlled by an appropriate controller (not illustrated) with the various components connected to the controller in the usual way.

The standalone ice dispenser may have a second ice delivery system or subsystem (not illustrated) which can deliver ice I in bulk form through a bulk delivery window 100.

While the invention has been particularly shown and described with reference to an embodiment thereof, it will be appreciated by those skilled in the art that various changes in form and detail may be made without departing from the spirit and scope of the invention.

I claim:

1. A dispenser comprising:

a housing having an interior bounded by at least one wall and a chute extending from the interior and through the wall;

a drum having an internal cavity and an upwardly oriented mouth, the drum rotatably disposed within the interior of the housing;

an advancing fin disposed on an inner surface of the internal cavity of the drum;

an ice maker attached to the housing such that the ice maker is adapted to receive water and turn the water into ice, the produced ice gravitationally falling from the ice maker into the mouth of the drum;

a bagging and delivery unit disposed below mouth of the drum such that the bagging unit causes the ice falling out of the mouth to be received within a bag with the bag and ice being delivered into the chute wherein the bagging and delivery unit comprises;

a hopper having a trap door that pivots between a raised position and a lowered position the hopper receiving ice from the drum;

a bag rack adapted to receive a plurality of bags;

a blower that blow opens one of the bags;

a floor panel capable of pivoting between a raised position and a lowered position; and wherein when the device is activated, the drum rotates such that the advancing fin causes the ice disposed within the internal cavity of the drum to advance out of the mouth and fall into the hopper and such that when a sufficient quantity of ice is present within the hopper, the drum discontinues rotating and thereafter the blower blow opens the bag and thereafter the trap door drops to the lowered position causing the ice within the hopper to drop into the blown open bag and thereafter the floor panel is pivoted to the raised position thereby delivering the bag with ice into the chute.

2. The dispenser as in claim 1 wherein the drum is rotated via a motor that is operationally connected to the drum.

3. The dispenser as in claim 1 further comprising a sensor located proximate the mouth of the drum such that the proximity senses for an ice backup in an ice delivery chute positioned between the ice maker and the mouth of the drum such that if the ice backup is sensed, the ice maker discontinues its delivery of ice to the drum and the drum is counterrotated.

4. The dispenser as in claim 1 wherein the trap door is controlled by a first mechanical actuator.

5. The dispenser as in claim 4 wherein the floor panel is controlled by a second mechanical actuator.

6. The dispenser as in claim 1 further comprising a payment system that receives a payment prior to dispensing of the ice.

7. The dispenser as in claim 1 further comprising a sensor that determines when sufficient ice is present within the hopper.

8. The dispenser as in claim 1 further comprising a weight sensor connected to the drum such that the weight sensor measures the weight of the drum so that when the weight of the drum is below a lower limit, the ice maker is activated and when the weight of the drum is above an upper limit, the ice maker is deactivated.

9. A dispenser comprising:

a housing having an interior bounded by at least one wall and a chute extending from the interior and through the wall;

a drum having an internal cavity and an upwardly oriented mouth, the drum rotatably disposed within the interior of the housing;

an advancing fin disposed on an inner surface of the internal cavity of the drum;

a motor that is operationally connected to the drum;

an ice maker attached to the housing such that the ice maker is adapted to receive water and turn the water into ice, the produced ice gravitationally falling from the ice maker into the mouth of the drum;

a weight sensor connected to the drum such that the weight sensor measures the weight of the drum so that when the weight of the drum is below a lower limit, the ice maker is activated and when the weight of the drum is above an upper limit, the ice maker is deactivated;

a bagging and delivery unit disposed below the mouth of the drum, such that the bagging unit causes the ice falling out of the mouth to be received within a bag with the bag and ice being delivered into the chute wherein the bagging and delivery unit comprises;

a hopper having a trap door that pivots between a raised position and a lowered position the hopper receiving ice from the drum;

a bag rack adapted to receive a plurality of bags;

a blower that blow opens one of the bags;

a floor panel capable of pivoting between a raised position and a lowered position; and wherein when the device is activated, the drum rotates via the motor such that the advancing fin causes the ice disposed within the internal cavity of the drum to advance out of the mouth and fall into the hopper and such that when a sufficient quantity of ice is present within the hopper, the drum discontinues rotating and thereafter the blower blow opens the bag and thereafter the trap door drops to the lowered position causing the ice within the hopper to drop into the blown open bag and thereafter the floor panel is pivoted to the raised position thereby delivering the bag with ice into the chute.

10. The dispenser as in claim 9 wherein the trap door is controlled by a first mechanical actuator.

11. The dispenser as in claim 10 wherein the floor panel is controlled by a second mechanical actuator.

12. The dispenser as in claim 9 further comprising a payment system that receives a payment prior to dispensing of the ice.

13. The dispenser as in claim 9 further comprising a sensor that determines when sufficient ice is present within the hopper.

14. The dispenser as in claim 9 further comprising a sensor located proximate the mouth of the drum such that the proximity senses for an ice backup in an ice delivery chute positioned between the ice maker and the mouth of the drum such that if the ice backup is sensed, the ice maker discontinues its delivery of ice to the drum and the drum is counterrotated.

* * * * *